US005664609A

United States Patent [19]

Herrlein et al.

[11] Patent Number: 5,664,609

[45] Date of Patent: Sep. 9, 1997

[54] WEAVING REED AND GRIPPER GUIDE ELEMENT FOR A LOOM

[75] Inventors: Wilhelm Herrlein, Neuravensburg; Hubertus Ludwig, Lindau-Bodolz, both of Germany

[73] Assignee: Lindauer Dornier Gesellschaft mbH, Lindau, Germany

[21] Appl. No.: 644,828

[22] Filed: May 10, 1996

[30] Foreign Application Priority Data

May 12, 1995 [DE] Germany ..... 195 17 493.3

[51] Int. Cl.[6] ..... D03D 47/27

[52] U.S. Cl. ..... 139/192; 139/449

[58] Field of Search ..... 139/192, 446, 139/449, 448, 438, 443, 444, 445, 196.2, 196.1, 196.3, 188 R, 189, 190, 191, 435.6

[56] References Cited

U.S. PATENT DOCUMENTS

| | | | |
|---|---|---|---|
| 2,603,242 | 7/1952 | Izquierdo . | |
| 3,487,859 | 1/1970 | Piccoli | 139/446 |
| 3,831,640 | 8/1974 | Wueger . | |
| 4,694,867 | 9/1987 | Gendelman et al. . | |
| 4,834,146 | 5/1989 | Pezzoli | 139/449 |
| 4,922,970 | 5/1990 | Gehring et al. . | |
| 5,251,673 | 10/1993 | Adachi et al. | 139/192 |

*Primary Examiner*—Andy Falik
*Attorney, Agent, or Firm*—W. G. Fasse; W. F. Fasse

[57] ABSTRACT

In a loom having mechanically driven weft thread insertion members, a weaving reed and a guide element for a weft thread gripper cooperate with one another, so that the guide element guidedly runs along the reed to provide an positive guidance for the gripper while it inserts a weft thread. To achieve this, each one of the reed teeth (6) has a profile recess (6D) therein between the upper and lower reed frame members (1A, 1B). The recesses are aligned with each other to form a guide channel across the width of the weaving reed (1). A protruding extension (13A) of the guide element (13) mounted on the gripper (12) is temporarily guidingly connected or engaged with the guide groove as the weft thread insertion members reach into and out of the loom shed.

20 Claims, 3 Drawing Sheets

WEAVING REED AND GRIPPER GUIDE ELEMENT FOR A LOOM

FIELD OF THE INVENTION

The invention relates to a weaving reed for a loom that has mechanically driven weft thread insertion members, wherein the weaving reed comprises a plurality of individual reed teeth that are arranged parallel and spaced apart from one another in a row and are anchored in respective first and second reed frame members. The invention further relates to a gripper guide and a guide element for a weft insertion gripper, which are temporarily guidingly connected to or in contact with the weaving reed.

BACKGROUND INFORMATION

German Patent 3,901,549 and corresponding U.S. Pat. No. 4,922,970 (Gehring et al.) discloses a gripper arrangement for a loom that has weft thread insertion carrier members, such as gripper rods or rapiers, which are alternately inserted into and retracted out of the loom shed, and has gripper members attached to the free ends of the carrier members. A guide element is arranged on a side wall of the gripper, so that the gripper glides along the reed with the guide element. Such a guide element is tiltably arranged on the side wall of the gripper so as to be tiltable in a direction perpendicular to the weft thread insertion direction. With that arrangement, the guide element can advantageously orient or align itself along the still-standing weaving reed during the control phase of the gripper, so that the largest possible lateral gliding surface of the gripper, i.e. of the guide element, is in contact with the reed. This achieves a quiet and smooth gripper motion. The entire disclosure of U.S. Pat. No. 4,922,970 (Gehring et al.) is incorporated herein by reference.

However, it has been found that the above described type of guide element does not reliably prevent the gripper from deviating from its prescribed guided path while carrying out the weft thread insertion, for example in a loom in which the grippers are arranged at the ends of rigid or flexible carrier members, such as gripper rods or rapiers, and in which the grippers are loosely or non-positively guided, for example, on a sley sole arranged on a reed stay bar of the loom. Especially in high speed looms, such a deviation of the gripper from its prescribed guided path is represented by the gripper lifting-off from the sley sole.

OBJECTS OF THE INVENTION

In view of the above it is the aim of the invention to achieve the following objects singly or in combination:

- to improve on conventional weaving reeds for looms having mechanically driven weft thread insertion members, in such a manner so as to provide an improved reed that is adapted to reliably guide, entirely across the weaving width, all types of linearly guided weft thread insertion members having grippers thereon;
- to provide an improved weaving reed that is adapted to cooperate with a gripper guide element to reliably prevent the gripper from lifting-off from the sley sole;
- to provide a gripper guide element having a proper arrangement and configuration to cooperate with an improved weaving reed so as to act as a connecting member between the gripper and the reed and provide positive guidance in the horizontal and vertical planes for the gripper in its travel into and out of the loom shed; and

- to provide a loom using a combination of an improved weaving reed and an improved gripper guide element that connects the gripper to the reed for sliding guidance therealong.

SUMMARY OF THE INVENTION

The above objects have been achieved by a weaving reed according to the invention, wherein the individual reed teeth each have a profile recess therein between the first and second reed frame members. The recesses in the reed teeth are aligned with one another to form a guide channel in the reed extending across the weaving width, are preferably arranged below a weft thread beat-up portion of the reed teeth, and are preferably shaped so that the resulting guide channel provides positive guidance for a gripper guide element.

The above objects have further been achieved by a guide element according to the invention, acting as an interconnecting member between a weft thread insertion gripper and a weaving reed. The guide element can be a guide finger arranged on the gripper. As seen in cross-section, the present guide element comprises an abutment surface extending parallel to and abutting a side wall of the gripper, a first slide or glide surface spaced away from and extending at an acute angle relative to the abutting surface, and a second or auxiliary glide surface extending from the first slide surface and forming a profiled extension of the guide element. The first glide surface is adapted to glide along the portion of the red teeth that beats-up the weft thread, and the second glide surface is adapted to glide along in the guide channel formed by the recesses in the reed teeth.

The above objects are especially achieved in a loom having weft thread insertion members that alternately are inserted into and retracted out of the loom shed, a weft thread gripper arranged on a free end of each insertion member, and a guide element preferably arranged on each weft thread gripper to support and guide the gripper along the weaving reed. The guide element and the weaving reed have the particular structure according to the present invention as described herein.

Especially in high speed gripper looms, in which the grippers are freely guided on a planar gripper running surface of a sley sole extending across the weaving width, or a sley sole formed of individual sections, it is a key feature of the invention that the individual reed teeth or lamellae of a weaving reed for beating-up the weft thread against the woven web each comprise at least one profiled recess, which is preferably arranged below the weft thread beat-up line. The profiled channel formed in the reed by the aligned individual recesses can have essentially any desired geometrical shape. For example, advantageous embodiments of the guide channel may have a slit shape, a circular shape, or a dovetail or swallow-tail shape. In such an embodiment, it is important that the beat-up side openings of the respective recesses are preferably positioned below the weft thread beat-up line.

In the above mentioned embodiments, the guide groove advantageously provides an additional degree or dimension of guidance for the gripper or the insertion members carrying the gripper, during their alternating motion into and out of the loom shed. Namely, the gripper is guided along the sley sole, which provides support in one direction, and the guide member provides additional guiding support in both the vertical and horizontal planes, as follows.

The guide element provided on the gripper, for example, laterally guides and supports the gripper against the weaving reed, and while maintaining the gliding guidance of the gripper along the weaving reed, additionally provides a further degree or dimension of support and guidance. To achieve this, the guide element comprises an extension protruding therefrom in a direction away from the side wall of the gripper. The cross-section of the protruding extension adequately or sufficiently corresponds to the cross-sectional shape of the guide channel formed by the recesses in the reed teeth so as to provide the positive guidance.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
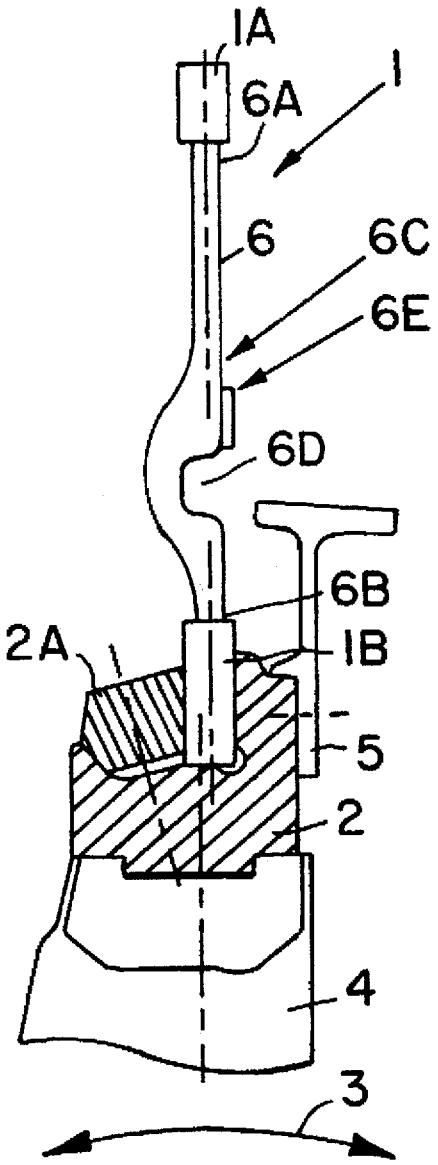
FIG. 1 is a side view of a weaving reed mounted on a reed stay bar, in which each individual reed tooth has a recess forming a profiled guide channel along the reed.

FIG. 1 shows a weaving reed 1 according to the invention connected to a reed stay bar 2 of a loom that is not shown in this figure. For example, the reed 1 is held or clamped into the reed stay bar 2 by a clamp bar 2A. The reed stay bar 2 is connected to a sley 4 that swings or oscillates back and forth as shown by the directional arrow 3. A T-shaped sley sole 5 is removably, and thus replaceably or exchangeably, arranged on the reed stay bar 2.

The weaving reed 1 comprises a plurality of lamellae or reed teeth 6 that are arranged spaced apart from one another in a row along the reed 1, and are anchored at their respective free ends 6A, 6B in a respective first or upper reed frame member 1A and a second or lower reed frame member 1B. As seen from the side, each reed tooth 6 has at least one recess 6D having a particular profile shape originating from or notched into a forward beat-up side or edge 6C of the tooth 6, at a location between the first and second reed frame members 1A, 1B. Preferably, the recess 6D is provided or notched into the respective reed tooth 6 at a location below the tooth area 6E that beats-up the weft thread against the beat-up edge of the woven web.

The individual reed teeth 6 are arranged one after another in a row along the reed frame members 1A, 1B so that the recesses 6D align with one another and form a guide channel across the width of the weaving reed 1. In the area of the profiled recess 6D, the backside of each reed tooth 6 opposite the beat-up side is bulged or curved outwardly, to ensure a sufficient strength and stability for the weaving reed 1 despite the provision of the recesses 6D.

Figure 2:
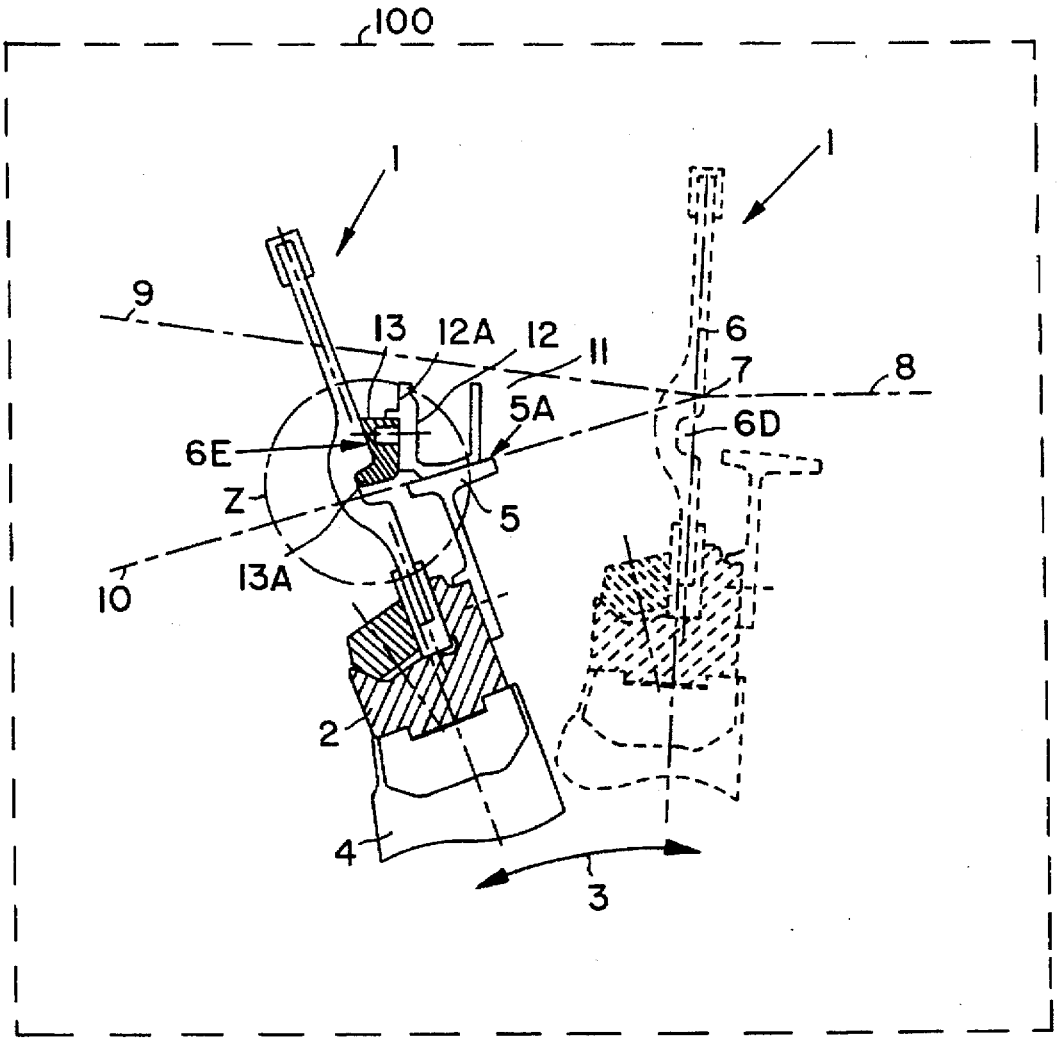
FIG. 2 is a side view of the weaving reed mounted on a reed stay bar according to FIG. 2, shown in cooperation with a weft thread gripper that is connected to the reed by a guide element.

FIG. 2 shows the weaving reed 1 according to the invention arranged in the reed stay bar 2 in its operating condition in a loom 100 that is merely represented schematically by a dashed-line box. The remaining components of the loom are not of significance for the present invention and can be of any conventional type and arrangement. In the solid-line view of FIG. 2, the sley 4 is located in a position tilted away from the beat-up edge 7 of the woven web 8, and dashed ghost lines show the sley in the beat-up position. In the solid-line position, the loom shed 11 formed by a plurality of upper warp threads 9 and lower warp threads 10 is opened. As shown here, the lower warp threads 10 may, for example, be supported by the planar upper surface 5A of the sley sole 5 connected to the reed stay bar 2. In order to insert the weft thread into the open loom shed 11, a gripper 12 connected to a carrier member such as a mechanically driven rapier weft threaded insertion member, which may be rigidly or flexibly embodied, is alternatingly inserted into and retracted out of the loom shed 11 with the gripper 12 gliding along on the lower warp threads 10, i.e. on the planar upper surface 5A of the sley sole 5 with the lower warp threads 10 therebetween.

A gripper guide element 13 is arranged on a sidewall 12A of the gripper 12 facing toward the weaving reed 1. The guide element 13 can be made of any conventional or otherwise suitable material, for example, a composite material comprising a cotton webbing impregnated with phenolic resin. The guide element 13 includes a body portion and a protruding extension 13A that has a cross-sectional or profile shape that adequately matches or fits with the shape of the recess 6D in the reed teeth 6. This protruding extension 13A of the guide element 13 glides along in the guide channel formed along the weaving reed 1 by the recesses 6D so as to provide gliding support and guidance for the gripper 12. Thus, the guide element 13 provides a gliding or sliding guidance along the weft thread beat-up surface 6C of the reed teeth 6 (which is known as such), but also simultaneously provides an additional degree or dimension of guidance by the protruding extension 13A which secures the gripper 12 from lifting-off of the sley sole 5A along which it runs.

Figure 3:
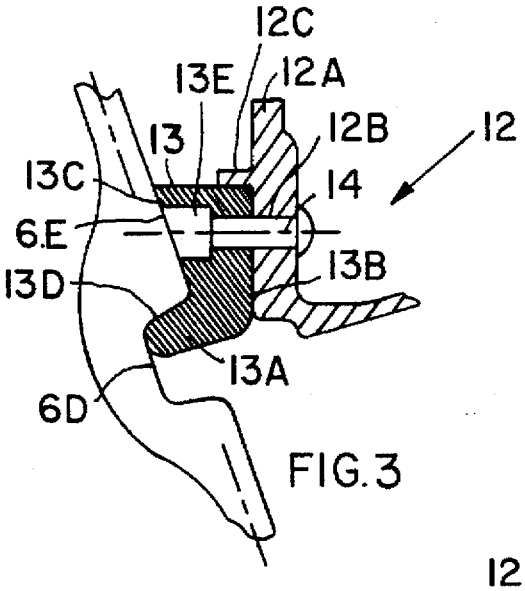
FIG. 3 is an enlarged detail view of the detail area "Z" of FIG. 2, particularly showing the guide element comprising a protruding extension piece.

FIG. 3 shows the detail area "Z" of FIG. 2, with the guide element 13 shown in cross-section. Only a portion of the gripper 12 is shown, likewise in section. The guide element 13 is arranged on a side wall 12A of the gripper 12 that faces toward the weaving reed 1. In order to elastically and easily exchangeably mount the guide element 13 on the gripper 12, the guide element 13 is provided with a countersunk hole 13E, and the side wall 12A of the gripper 12 is provided with a through-hole 12B, through which an elastic connector element 14 is insertable and fixable. The countersunk hole 13E for example allows for normal wear of the guide element 13 before it is replaced. The elastic connector element 14 may, for example, be an elastic or rubbery rivet-like member. A ridge 12C protrudes from the side wall 12A of the gripper 12 to provide a positioning edge and a seat against which the guide element 13 can be positioned, to facilitate installation of the replaceable guide element 13. The guide element 13 may be mounted on the gripper 12 in any manner described in above mentioned U.S. Pat. No. 4,922,970.

According to the present invention, the guide element 13 includes at least one abutment surface 13B that extends parallel to the side wall 12A of the gripper 12, at least one first gliding surface 13C spaced apart from and extending at an acute angle relative to the abutment surface 13B, and at least one second or auxiliary glide surface 13D that extends from the first glide surface 13C and forms a profiled contour of the protruding extension 13A. The glide surface 13D extends around the protruding extension 13A and transitions back into the abutment surface 13B.

Figure 4:
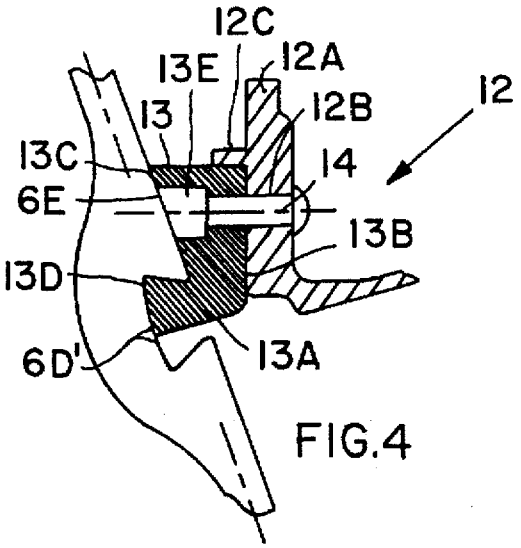
FIGS. 4 and 5 are respective side views of alternative embodiments having different shaped recesses in the reed teeth.
Figure 5:
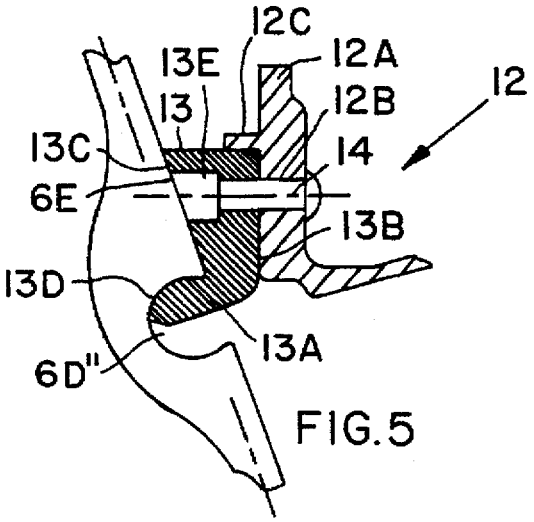

FIG. 3 shows one embodiment of the recesses 6D having a substantially rectangular notch shape, and a correspondingly shaped embodiment of the protruding extension 13A. FIGS. 4 and 5 show two alternative embodiments, with dove-tail or swallow-tall shaped recesses 6D', or partially circular shaped recesses 6D", respectively. The construction and arrangement of the components is otherwise the same. In the embodiments of FIGS. 4 and 5, the protruding extension 13A of the guide member 13 positively engages in the recesses 6D, to particularly provide a positive guidance for the gripper 12, and prevent the gripper 12 from deviating from its intended insertion path running along the upper planar surface 5A of the sley sole 5.

Although the invention has been described with reference to specific example embodiments, it will be appreciated that it is intended to cover all modifications and equivalents within the scope of the appended claims.

What is claimed is:

1. In a loom having a mechanically driven rapier weft thread insertion member for inserting a weft thread, an improved weaving reed comprising a first reed frame member, a second reed frame member, and a plurality of reed teeth that are arranged spaced apart and parallel to each other in a row and that are respectively connected between said first and second reed frame members, wherein said reed teeth respectively have profile recesses with at least one of said profile recesses provided in each one of said reed teeth between said first and second reed frame members, and wherein said recesses are adapted to guide the rapier weft thread insertion member across a weaving width of said reed.

2. The weaving reed in the loom according to claim 1, wherein said reed teeth respectively have front edges adapted to face toward and beat-up said weft thread in the loom and back edges opposite said front edges, and said recesses respectively have the form of notches in said front edges.

3. The weaving reed in the loom according to claim 2, wherein said back edges of said reed teeth respectively comprise outward bulges adjacent said notches.

4. The weaving reed in the loom according to claim 1, wherein said recesses of said reed teeth are aligned with each other along said weaving reed and form at least one guide channel across said weaving width of said weaving reed.

5. The weaving reed in the loom according to claim 4, wherein the rapier weft thread insertion member of the loom includes a guide element, and said recesses are shaped and arranged so that said guide channel is adapted to guidingly receive the guide element moving along said guide channel.

6. The weaving reed in the loom according to claim 4, wherein said recesses are respectively shaped so that said guide channel provides a positive constrained guidance for the rapier weft thread insertion member.

7. The weaving reed in the loom according to claim 6, wherein said recesses respectively have a dovetail notch shape.

8. The weaving reed in the loom according to claim 6, wherein said recesses respectively have an overall notch shape that is a part of a circle.

9. The weaving reed in the loom according to claim 1, wherein said reed teeth respectively have beat-up portions adapted to beat-up the weft thread in the loom, and a central axis of said recesses along said weaving reed is located below said beat-up portions of said reed teeth.

10. A loom comprising a weaving reed, and a weft thread insertion member adapted to be alternately inserted into and retracted out of a loom shed formed in said loom, wherein:

said weft thread insertion member comprises a carrier member, a weft thread gripper arranged at an end of said carrier member, and a guide element that contacts said weaving reed in a guidedly movable manner, said guide element includes a protruding extension that protrudes toward said weaving reed, said weaving reed comprises a first reed frame member, a second reed frame member, and a plurality of reed teeth extending between and respectively connected to said first and second reed frame members, said reed teeth respectively comprise beat-up edges adapted to beat-up a weft thread in said loom and back edges opposite said beat-up edges, and respectively have profile recesses in said beat-up edges, said profile recesses of said reed teeth substantially align with each other to form a guide channel extending along a weaving width of said weaving reed, and said protruding extension of said guide element has a profile shape adapted to reach into said profile recesses and at least temporarily engages said guide channel in a guidedly movable manner.

11. The loom of claim 10, wherein said beat-up edges of said reed teeth respectively include beat-up portions adapted to contact and perform said beat-up of said weft thread, and said profile recesses of said reed teeth are positioned below said beat-up portions.

12. The loom of claim 10, wherein said guide element is a guide finger arranged on said gripper.

13. The loom of claim 10, wherein said guide element is a replaceable component that is removably mounted on said gripper.

14. The loom of claim 10, wherein said guide element includes a guide element body mounted on said gripper, and said protruding extension protrudes from said guide element body.

15. The loom of claim 14, wherein said guide element body includes a first guide surface that slidingly contacts said beat-up edges of said reed teeth, and said protruding extension includes a second guide surface that extends at an angle relative to said first guide surface and that slidingly contacts a side of said guide channel.

16. The loom of claim 15, further comprising a rockable sley and a sley sole having a planar top surface, with said reed and said sley sole mounted adjacent one another on said sley, wherein said gripper is arranged to be movable with gliding contact on said planar top surface of said sley sole, and said second guide surface is substantially parallel to said planar top surface so that said contact of said second guide surface on said side of said guide channel holds said gripper positively against said planar top surface.

17. The loom of claim 10, wherein said profile recesses respectively have the form of notches in said beat-up edges, and said back edges respectively have outward bulges adjacent said notches in said beat-up edges.

18. The loom of claim 17, wherein said notches respectively have substantially rectangular shapes.

19. The loom of claim 17, wherein said notches respectively have dovetail shapes.

20. A guide element for guidingly interconnecting a weft thread insertion gripper and a weaving reed in a loom, said guide element comprising an abutment surface adapted to abut against a side wall of the gripper, an elastic mounting element adapted to connect said guide element to the gripper, a first gliding contact guide surface that is spaced apart from and extends at an acute angle relative to said abutment surface and that is adapted to make gliding contact with a beat-up edge of reed teeth of the reed, and a second gliding contact guide surface that extends from said first guide surface and forms a profile contour that runs into said abutment surface.

* * * * *